US008573954B2

(12) United States Patent
Yoo et al.

(10) Patent No.: US 8,573,954 B2
(45) Date of Patent: Nov. 5, 2013

(54) FAN ASSEMBLY

(75) Inventors: Myung-Keun Yoo, Seoul (KR); Hyoun-Jeong Shin, Incheon (KR)

(73) Assignee: LG Electronics Inc., Seoul (KR)

( * ) Notice: Subject to any disclaimer, the term of this patent is extended or adjusted under 35 U.S.C. 154(b) by 807 days.

(21) Appl. No.: 12/337,110

(22) Filed: Dec. 17, 2008

(65) Prior Publication Data

US 2009/0185919 A1 Jul. 23, 2009

(30) Foreign Application Priority Data

Jan. 21, 2008 (KR) ..... 10-2008-0006351

(51) Int. Cl.
*F04D 25/08* (2006.01)
*F04D 19/00* (2006.01)

(52) U.S. Cl.
USPC ..... 417/423.9; 417/354; 417/423.14

(58) Field of Classification Search
USPC ..... 417/423.1, 423.7, 423.9, 423.14, 354
See application file for complete search history.

(56) References Cited

U.S. PATENT DOCUMENTS 4,934,041 A * 6/1990 Hoover et al. ..... 29/596
5,574,321 A * 11/1996 Baker ..... 310/67 R
5,962,938 A * 10/1999 Bobay et al. ..... 310/67 R
5,986,379 A * 11/1999 Hollenbeck et al. ..... 310/257
6,158,985 A 12/2000 Watanabe et al.
6,376,946 B1 * 4/2002 Lee ..... 310/67 R
6,551,074 B2 * 4/2003 Kudo et al. ..... 417/354
6,572,346 B2 * 6/2003 Hsieh ..... 417/354
6,616,422 B2 * 9/2003 Hsieh ..... 417/423.9
6,707,199 B2 * 3/2004 Chang et al. ..... 310/90
6,713,907 B2 * 3/2004 Matsumoto ..... 310/67 R
6,940,195 B2 * 9/2005 Chang et al. ..... 310/91
2002/0025261 A1 2/2002 Kudo et al.
2004/0033138 A1 2/2004 Jung et al.
2004/0101409 A1 5/2004 Jung et al.
2004/0145250 A1 7/2004 Kudo et al.
2005/0053493 A1 3/2005 Chung et al.
2005/0132730 A1 6/2005 Lim et al.
2005/0160760 A1 7/2005 Chae et al.

OTHER PUBLICATIONS

Chinese Office Action dated Sep. 7, 2010 issued in Application No. 200910002563.3.
U.S. Appl. No. 12/327,039 to Yoo et al., filed Dec. 3, 2008.
U.S. Appl. No. 12/337,078 to Yoo et al., filed Dec. 17, 2008.
European Search Report dated May 22, 2012.

* cited by examiner

*Primary Examiner* — Peter J Bertheaud
(74) *Attorney, Agent, or Firm* — KED & Associates LLP

(57) ABSTRACT

A fan assembly including a rotation shaft, a permanent magnet having a receiving space therein and rotatable around a central axis of the rotation shaft, a fan including a hub having a receiving space therein with one side open and disposed outside the permanent magnet, the fan being rotatable around the central axis of the rotation shaft, a stator disposed inside the permanent magnet, and a blocking portion disposed at the open side of the hub in an axial direction, the combination configured to block an introduction of foreign materials into the fan assembly and to reduce the size of the fan assembly.

14 Claims, 14 Drawing Sheets

FAN ASSEMBLY

CROSS-REFERENCE TO RELATED APPLICATIONS

This application claims the benefit of Korean Application No. 10-2008-0006351, filed on Jan. 21, 2008, which is herein expressly incorporated by reference in its entirety.

BACKGROUND OF THE INVENTION

1. Field of the Invention

The present invention relates to a fan assembly, and more particularly, to a fan assembly which prevents an introduction of foreign materials into the fan assembly to avoid a restriction of the movement of rotatable components due to the introduction of the foreign materials, and ultimately the deterioration of such components due to the presence of the foreign materials.

2. Background of the Invention

In general, refrigerators are appliances used to keep items frozen and/or refrigerated therein. Related art refrigerators may include a refrigerator main body having a cooling chamber therein and a refrigeration cycle device having a compressor and a condenser, for maintaining a cooled state in the cooling chamber.

A machine chamber is disposed at a rear region of the refrigerator main body, and the compressor and the condenser are provided in the machine chamber. A fan for accelerating air flow is also provided inside the machine chamber so as to facilitate the cooling of the condenser and/or the compressor.

A cool air channel for allowing the circulation of air in the cooling chamber may be provided at one side of the cooling chamber in the refrigerator main body. An evaporator for allowing a heat-exchange of air, and a cool air blower fan for blowing the cool air heat-exchanged through the evaporator into the cooling chamber are provided in the cool air channel.

However, since the cool air blower fan is disposed at one side of the evaporator, defrosting by the evaporator may occur and unwanted moisture may be generated. In this regard, the moisture may negatively interfere with the operation of the rotatable components and reduces the lifespan of components. Similarly, if frost or ice are introduced between rotatable elements and fixed elements of the cool air blower fan, the frost or ice may restrict the movement of the rotatable elements, and thus facilitate a forced deterioration of such components, as well as possible malfunction of the fan's operation.

Also, since the machine chamber may contain a relatively great deal of dust and foreign materials, it may be easy for dust or foreign materials, e.g., bugs, to be introduced between the rotatable elements and the fixed elements of the blowing fan, resulting in further restriction of the movement of the rotatable elements.

Furthermore, such foreign materials introduced between the rotatable elements and the fixed elements may also facilitate rapid deterioration of the components, thereby causing malfunctioning and thus further shortening the lifespan of the blowing fan.

SUMMARY OF THE INVENTION

Therefore, in order to solve the abovementioned problems, the present invention provides a fan assembly configured to block an introduction of foreign materials.

A feature of the present invention is to provide a fan assembly capable of preventing foreign materials from entering the fan assembly and deteriorating components therein. An additional feature of the present invention is to provide a fan assembly that that is reduced in dimension such that it require less space and may be available for various applications that utilize fan assemblies.

To achieve these and other features, a non-limiting embodiment provides a fan assembly that may including a rotation shaft, a permanent magnet rotatable around a central axis of the rotation shaft, a fan including a hub having a receiving space therein with one side open and disposed outside the permanent magnet, the fan being rotatable around the central axis of the rotation shaft, a stator disposed inside the permanent magnet, and a blocking portion disposed at the open side of the hub configured to prevent foreign materials from entering an interior of the permanent magnet.

In non-limiting embodiments, the fan assembly may include a printed circuit board (PCB) disposed at the open side of the hub, and a molding portion configured to allow the PCB to be integrally connected to an end portion of the stator.

In non-limiting embodiments, an end portion of the permanent magnet is provided at an interior of the blocking portion such that the blocking portion overlaps the end portion of the permanent magnet in an axial direction.

The blocking portion may include a rib protruding from the molding portion in an axial direction and extending in a circumferential direction so as to be disposed at one side of at least one of the permanent magnet or the hub.

In another non-limiting embodiment the blocking portion may include a first blocking portion provided at the molding portion to overlap one side of an end portion of the permanent magnet in an axial direction, and a second blocking portion provided at the molding portion to overlap one side of an end portion of the hub in the axial direction.

The hub may be configured to have a cross-section having a diameter gradually increasing toward the open side of the hub.

The blocking portion may be configured to be disposed at an outer circumferential surface of the hub.

The blocking portion may protrude from the molding portion, may be disposed outside the hub, and may extend in a circumferential direction.

In non-limiting embodiments, a bearing assembly for supporting the rotation shaft may be provided at one side of the molding portion, and the blocking portion may protrude from the bearing assembly and extends around the hub.

The fan assembly may also include a frame disposed inside the hub, coupled to the rotation shaft, and rotatably supporting the permanent magnet.

In alternative non-limiting embodiments, a permanent magnet supporting portion may be configured as a recessed portion of an inner diameter surface of the frame in the radial direction coupling the permanent magnet thereto.

In non-limiting embodiments, the hub may further include a nipple protruding from a central area of the hub in an axial direction, and a shaft receiving portion in which an end portion of the rotation shaft is inserted.

In non-limiting embodiments, a permanent magnet supporting portion may protrude from an inner surface of the hub in an axial direction and extend in a circumferential direction.

In further non-limiting embodiments, a fan assembly may include a rotation shaft, a permanent magnet rotatable around a central axis of the rotation shaft, a fan including a hub having a receiving space therein with one side open and disposed outside the permanent magnet, the fan being rotatable around the central axis of the rotation shaft, a stator disposed inside the permanent magnet, a first blocking portion disposed to overlap an end portion of the permanent magnet in an axial direction, and a second blocking portion disposed at the open side of the hub and spaced apart from the first blocking portion in a radial direction.

The fan assembly as described above may include a printed circuit board (PCB) disposed at the open side of the hub, and a molding portion configured to allow the PCB to be integrally connected to an end portion of the stator.

In embodiments, the hub may be cylindrical, and the first blocking portion and the second blocking portion may be provided at the molding portion such that an end portion of the permanent magnet and an end portion of the hub can be inserted thereinto, respectively.

In still further non-limiting embodiments, a fan assembly may be provided that includes a rotation shaft, a permanent magnet rotatable around a central axis of the rotation shaft, a fan including a hub having a receiving space therein with one side open and disposed outside the permanent magnet, the fan being rotatable around the central axis of the rotation shaft, a stator disposed inside the permanent magnet; a printed circuit board (PCB) disposed at the open side of the hub, a molding portion configured to allow the PCB to be integrally connected to an end portion of the stator, and a blocking portion extending from an end portion of the hub outside the molding portion in the axial direction to overlap the hub.

While the present invention is described herein as being used with refrigeration systems, it is not limited to such applications. In this regard, the present invention further contemplates use of the fan assembly in, but not limited to computer systems, HVAC systems, automotive applications, alone, and other known cooling and heating systems.

The foregoing features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles, features and advantages of the invention.

In the drawings.

DETAILED DESCRIPTION OF THE INVENTION

Description will now be given in detail of a fan assembly in accordance with non-limiting embodiments of the present invention, with reference to the accompanying drawings. Although some embodiments are illustrated herein, it should be understood that numerous other modifications and embodiments can be devised by those skilled in the art that will fall within the spirit and scope of the principles of the present invention.

Figure 1:
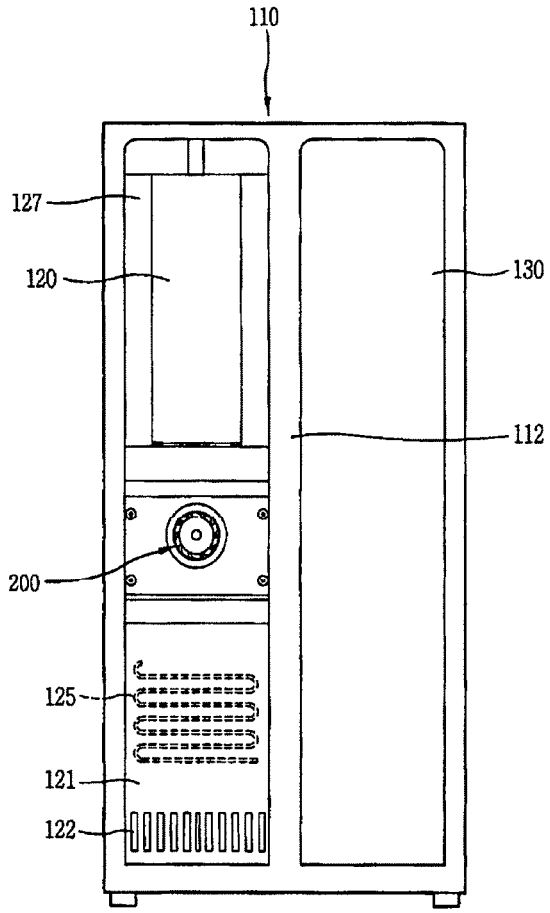
FIG. 1 is a front view of a refrigerator having a fan assembly in accordance with a non-limiting embodiment of the present invention.

As shown in FIG. 1, a refrigerator may include a refrigerator main body 110 having a freezing chamber 120 and a refrigerating chamber 130 separated by a partition wall 112 therebetween, and a freezing chamber door (not shown) and a refrigerating chamber door (not shown) both coupled to a front surface of the refrigerator main body 110 so as to open/close the interiors of the freezing chamber 120 and the refrigerating chamber 130.

A cover 121 is disposed at a rear lower region of the freezing chamber 120. An evaporator 125, through which air is heat-exchanged to be cooled, is provided at a rear side of the cover 121. Inlet holes 122, through which air inside the freezing chamber 120 is introduced, are provided at a lower region of the cover 121.

A fan assembly 200 in accordance with a non-limiting embodiment of the present invention is disposed above the evaporator 125. A cool air duct 127 is disposed at an upper side of the fan assembly 200. The cool air duct 127 includes a cool air channel therein such that cool air from the evaporator 125 flows through and is discharged from the cool air channel.

Figure 2:
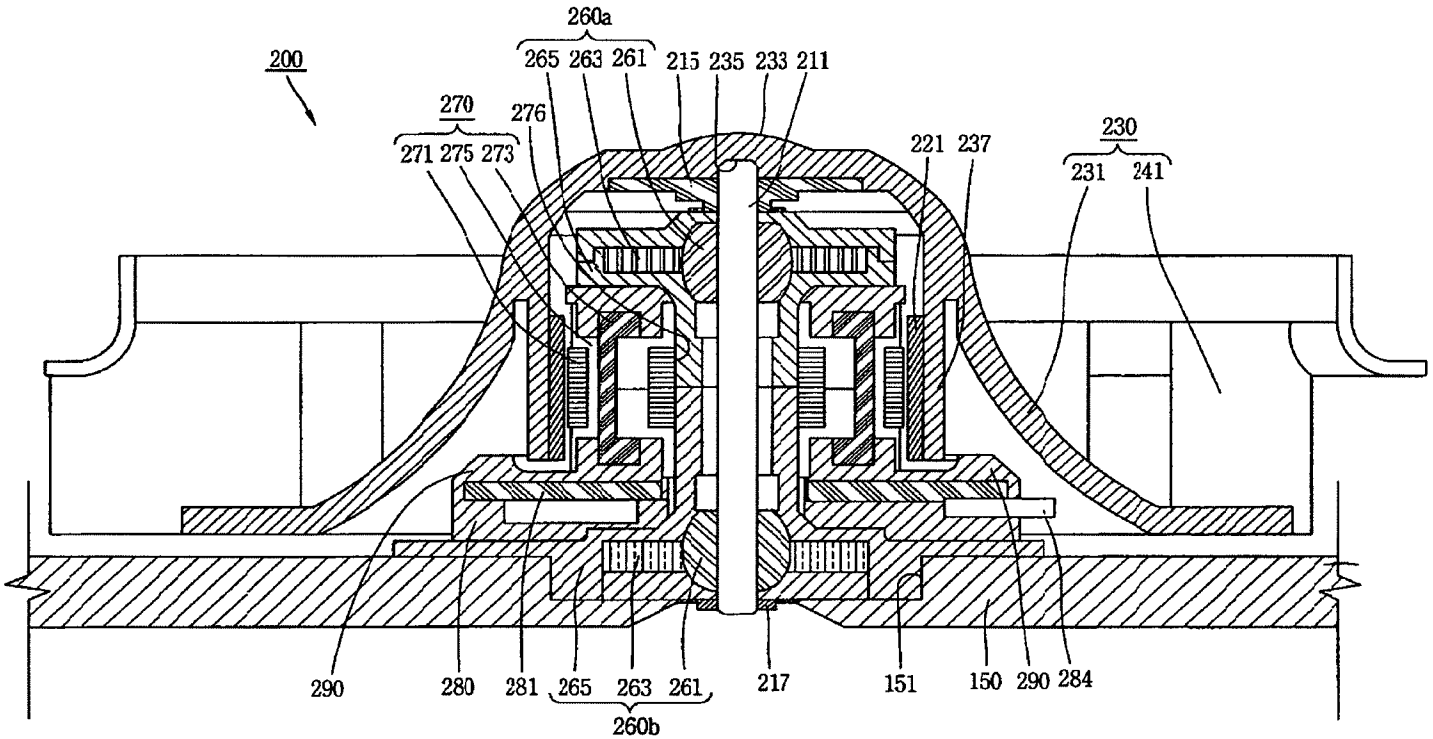
FIG. 2 is a cross-sectional view of the fan assembly in FIG. 1.

As shown in FIG. 2, the fan assembly 200 may include a rotation shaft 211, a permanent magnet 221 having a receiving space therein and rotatable around a central axis of the rotation shaft 211, a fan 230 being rotatable around the central axis of the rotation shaft 211, and including a hub 231 having a receiving space therein with one side open and disposed outside the permanent magnet 221, and a plurality of blades 241 disposed at a circumference of the hub 231, a stator 270 disposed inside the permanent magnet 221, and a blocking portion 290 disposed to overlap at least one of an end portion of the permanent magnet 221 and the open side of the hub 231 by a certain distance in an axial direction.

The fan assembly 200 may be supported by a mount plate 150. The mount plate 150 is provided with a receiving portion 151 in which the fan assembly 200 is partially received.

The fan 230 may be implemented as a centrifugal fan which includes the hub 231 having one side thereof open and cylindrically formed to have the receiving space therein. The present invention contemplates that the hub 231 may be formed in any suitable shape. The plurality of blades 241 protrude from the circumference of the hub 231 in the axial direction at spaced intervals and are inclined along the circumferential direction, whereby the fan 230 intakes air in the axial direction and discharges air in a radial direction.

The rotation shaft 211 is disposed at a central portion of the hub 231. A first bearing assembly 260*a* and a second bearing assembly 260*b* are coupled to the circumference of the rotation shaft 211 so as to rotatably support the rotation shaft 211. The stator 270 is disposed around the first bearing 260*a* and the second bearing assembly 260*b*. A shaft base 215 is disposed at one end portion of the rotation shaft 211, i.e., a top end portion of the rotation shaft 211 in the drawing. The shaft base 215 is integrally rotatably coupled to the central portion of the hub 231 of the fan 230 via a high frequency bonding, although other suitable bonding techniques are contemplated by the present invention. In this regard, a nipple 233 which outwardly protrudes from the central area of the hub 231 in an axial direction includes a shaft receiving portion 235 into which an end portion of the rotation shaft 211 is inserted. This construction facilitates a coupling between the rotation shaft 211 and the hub 231 and additionally allows suitable mating between the rotation shaft 211 and the rotational center of the hub 231. Moreover, such components can restrict the rotation shaft 211 and the hub 231 coupled to each other from being moved with respect to a vertical direction. A fixing unit, e.g., a fixing ring 217, is disposed at the other end of the rotation shaft 211 so as to prevent the separation of the second bearing assembly 260*b*.

The stator 270 may include a stator core 271 laminated (or insulated in any suitable manner) in the axial direction, a stator coil 273 wound onto the stator core 271, and an insulator 275 interposed between the stator core 271 and the stator coil 273 for the insulation therebetween. A coupling portion 276 coupling the first bearing assembly 260*a* and the second bearing assembly 260*b* is provided in a central area of the stator 270.

The permanent magnet 221 is disposed outside the stator 270 to be spaced apart from the stator 270 with a certain air gap so as to be configured as an outer rotor type motor. A molding portion 280 is formed at an end portion of one side of the stator 270, i.e., a bottom end portion of the stator 270 in the drawing. A PCB (Printed Circuit Board) 281 is disposed at the bottom side of the stator 270. The molding portion 280 may be formed in any suitable shape, such as a disc shape with a certain thickness such that the stator 270 can be integrally connected to the PCB 281. The molding portion 280 may be formed of any suitable material, such as thermoplastic resin to cover the bottom end portion of the stator 270 and the PCB 281.

A permanent magnet supporting portion 237 is provided inside the hub 231 which may be formed in any suitable shape, such as a cylindrical shape, and protrudes parallel with the rotation shaft 211 to extend in the circumferential and axial directions of the hub 231.

The permanent magnet 221 may be formed in any suitable shape, such as a cylindrical shape, and pole-anisotropically magnetized, whereby the permanent magnet supporting portion 237 does not have to include a back yoke. The surface of the permanent magnet 221 is coated with coatings, such as parylene or any suitable coating, so as to prevent a performance degradation due to moisture. The permanent magnet 221 is adhered onto an inner diameter surface of the permanent magnet supporting portion 237 with an adhesive, such as Loctite or the like, although other suitable adhesion mechanisms are contemplated by the present invention.

The blocking portion 290 is provided at the molding portion 280 outside the permanent magnet 221 and the permanent magnet supporting portion 237, such that the blocking portion 290 overlaps a portion of an outer circumferential surface of the permanent magnet 221 and the permanent magnet supporting portion 237 by a certain length in the axial direction. Accordingly, the introduction of external foreign materials inside the permanent magnet supporting portion 237 can be prevented and thus the restriction of the movement of the rotatable elements and the rapid deterioration of the same can also be prevented.

Figure 3:
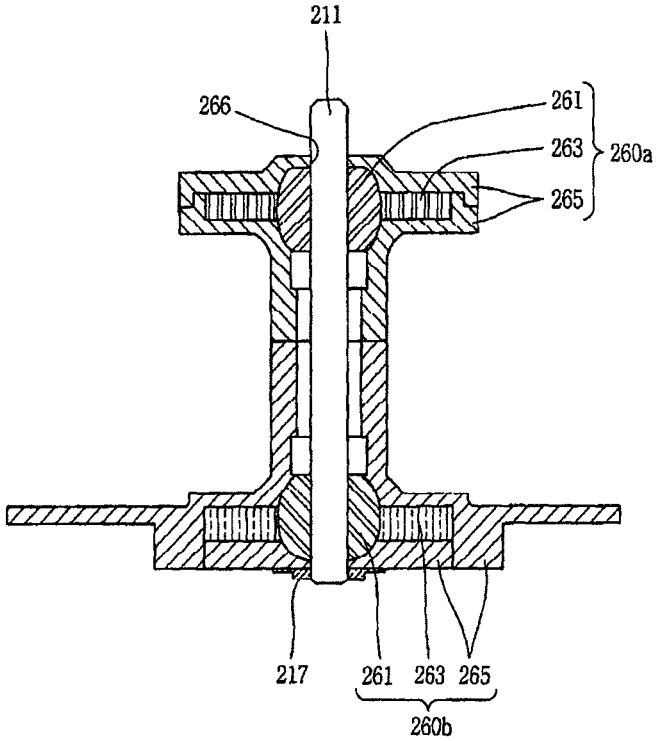
FIG. 3 shows an enlarged view of a first bearing assembly and a second bearing assembly of the fan assembly in FIG. 2 in accordance with a non-limiting embodiment of the present invention.

As shown in FIG. 3, the first bearing assembly 260*a* and the second bearing assembly 260*b* may respectively include a bearing 261 coupled to the circumference of the rotation shaft 211 to rotatably support the rotation shaft 211, a felt 263 containing oil or other suitable lubricants and contacting a circumference of the bearing 261, and housing 265 covering both the bearing 261 and the felt 263.

Figure 4:
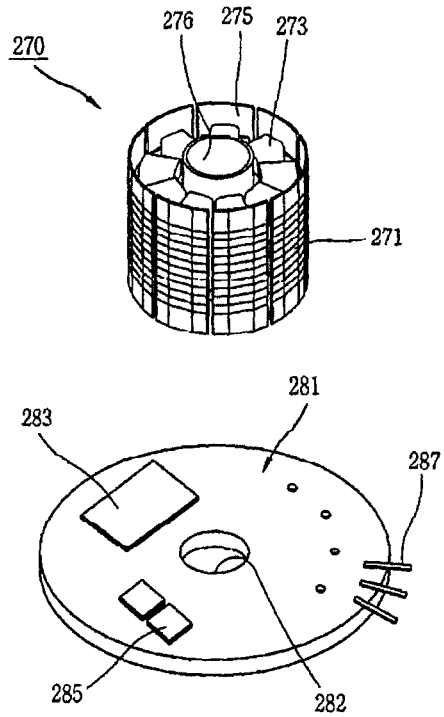
FIG. 4 shows a perspective view of a stator and a PCB (Printed Circuit Board) before forming a molding portion in FIG. 2 in accordance with a non-limiting embodiment of the present invention.

As shown in FIG. 4, the PCB 281 may be formed in any suitable shape, such as a disc, and includes a 3-phase drive integrated circuit (IC) 283, a capacitor 285 and connection terminals 287 to be electrically connected to the exterior. A through hole 282 in which the second bearing assembly 260*b* is inserted is provided in the central area of the PCB 281.

Figure 5:
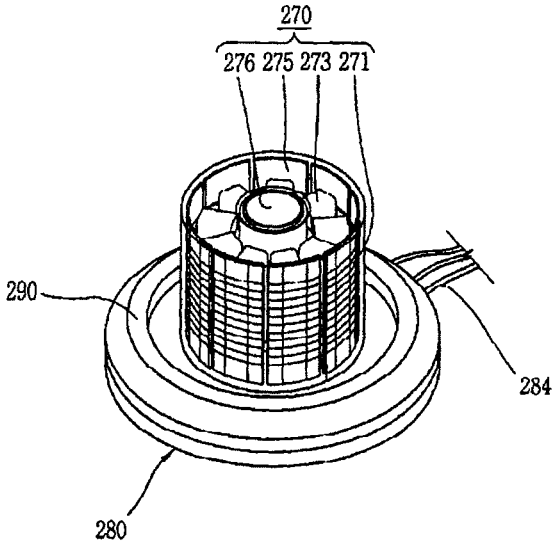
FIG. 5 shows a perspective view of the stator and the PCB after forming the molding portion in FIG. 2 in accordance with a non-limiting embodiment of the present invention.

As shown in FIG. 5, the molding portion 280 may be formed in any suitable shape, such as a disc shape with a certain thickness by using thermoplastic resin (or any suitable material) such that the stator 270 can be disposed at the upper central area of the PCB 281, and part of the lower end portion of the stator 270 and the PCB 281 can be covered. The blocking portion 290 is provided on an upper surface of the molding portion 280, so as to protrude outside the permanent magnet 221 and the permanent magnet supporting portion 237 in the radial direction of the permanent magnet 221, thereby overlapping the permanent magnet 221 and the permanent magnet supporting portion 237 by a certain length in the axial direction. The blocking portion 290 is cylindrical in shape (although other suitable shapes are contemplated by the present invention) and extends in a circumferential direction of the permanent magnet 221. Thus, upon rotation of the permanent magnet 221 and the permanent magnet supporting portion 237, foreign materials can be blocked from being introduced inside, thereby eliminating the restriction of the movement of the rotatable components and and rapid deterioration of the same. Cables 284 connected to the PCB 281 are drawn out of one side of the molding portion 280.

Figure 6:
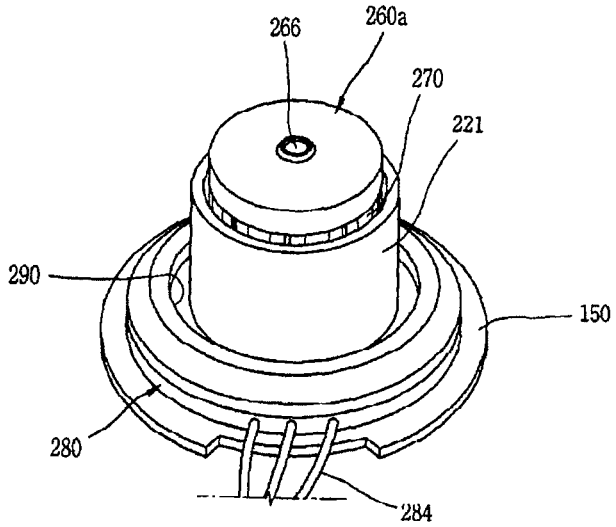
FIG. 6 shows a perspective view of a coupled state of the molding portion and the first bearing assembly of FIG. 5 in accordance with a non-limiting embodiment of the present invention.

As shown in FIG. 6, a mount plate 150 is coupled to a lower side of the molding portion 280. Further, as shown in at least FIG. 5, the first bearing assembly 260*a* and the second bearing assembly 260*b* are coupled to upper and lower sides of the coupling portion 276 of the stator 270, respectively.

Figure 7:
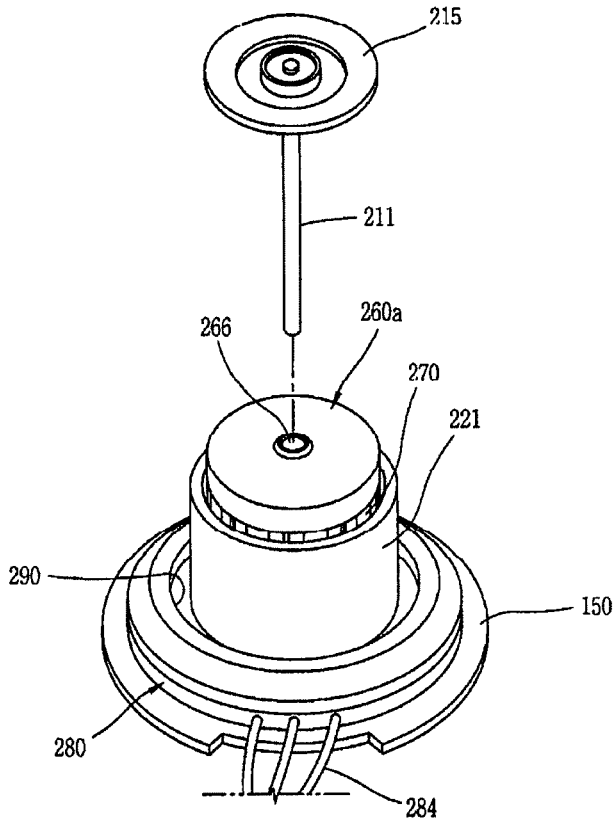
FIG. 7 shows a perspective view of the first bearing assembly and a rotation shaft of FIG. 6 before coupling in accordance with a non-limiting embodiment of the present invention.

As shown in FIG. 7, the end portion of the rotation shaft 211 to which the shaft base 215 is coupled is inserted into a shaft opening 266 of the first bearing assembly 260*a* so as to be protruded to a lower side of the second bearing assembly 260*b*. The fixing ring 217 is coupled to the end portion of the rotation shaft 211 protruding from the outside of the second bearing assembly 260*b*, thereby preventing the separation of the second bearing assembly 260*b*, and thus maintaining the first and second bearing assemblies together.

The operation of the fan assembly in accordance with a non-limiting embodiment of the present invention will now be described.

Upon applying power to the stator coil 273, the permanent magnet 221 and the fan 230 rotate around the central axis of the rotation shaft 211 by the interaction between the stator coil 273 and the permanent magnet 221. In this regard, the first bearing assembly 260*a* and the second bearing assembly 260*b* allow smooth rotation of the rotation shaft 211. During operation, the blocking portion 290 protrudes from the molding portion 280 in the axial direction to overlap the permanent magnet supporting portion 237 by a certain distance, thereby blocking the introduction of external foreign materials inside the permanent magnet supporting portion 237.

A fan assembly in accordance with a second non-limiting embodiment of the present invention will now be described with reference to FIG. 8. The same configurations to the aforementioned and illustrated configurations are given with the same reference numerals for the sake of explanation. Thus, detailed description thereof will not be repeated.

Figure 8:
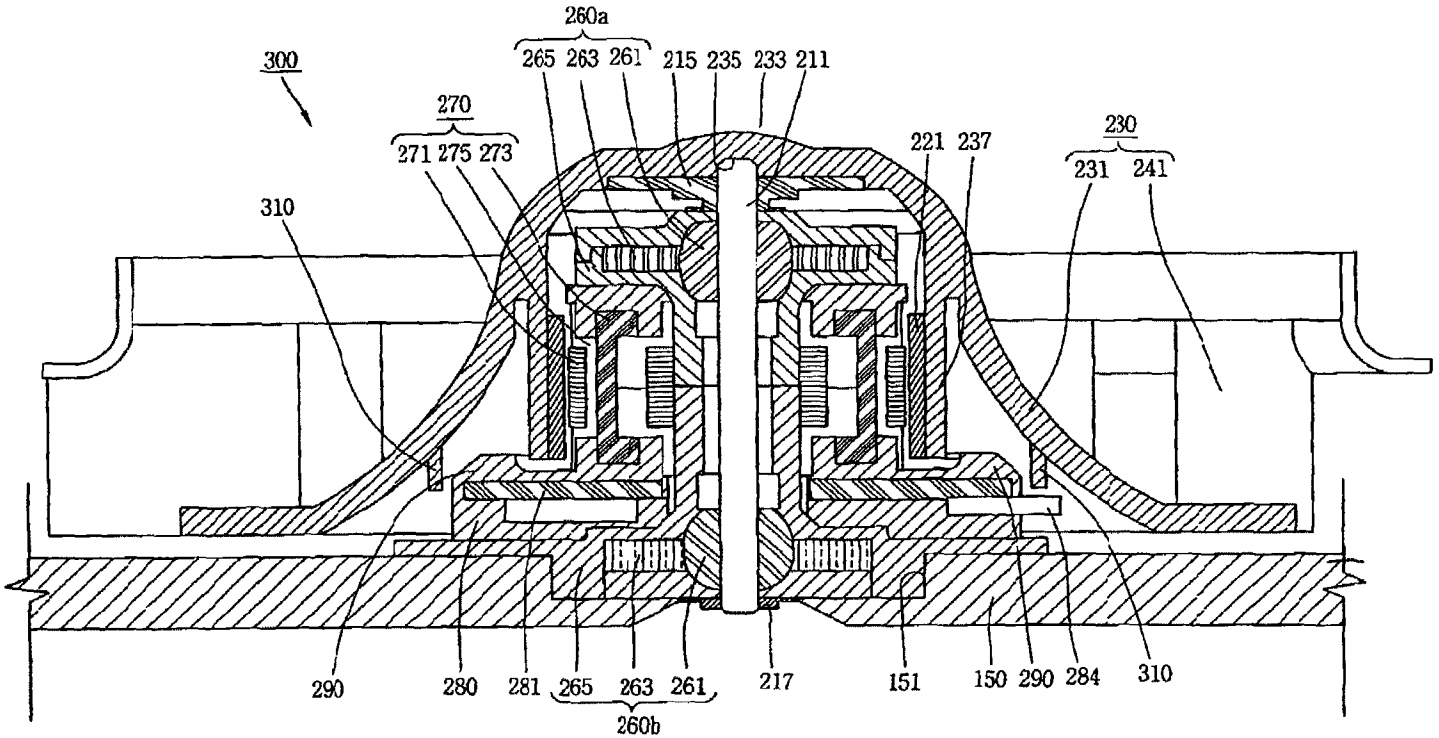
FIG. 8 shows a cross-sectional view of a fan assembly in accordance with an alternative non-limiting embodiment of the present invention.

As shown in FIG. 8, a fan assembly 300 may include a rotation shaft 211, a permanent magnet 221 having a receiving space therein and rotatable around the central axis of the rotation shaft 211, a fan 230 rotatable around the central axis of the rotation shaft 211, and including a hub 231 having a receiving space therein with one side open and disposed outside the permanent magnet 221, and a plurality of blades 241 disposed at the circumference of the hub 231, a stator 270 provided inside the permanent magnet 221, a first blocking portion 290 disposed to overlap the end portion of the permanent magnet 221 by a certain distance in an axial direction, and a second blocking portion 310 disposed at the open side of the hub 231 to be spaced apart from the first blocking portion 290 in a radial direction.

The fan 230 may be implemented as a centrifugal fan which includes the hub 231 having one side open and cylindrically formed to have the receiving space therein. The present invention also contemplates other suitable shapes for the hub 231. The plurality of blades 241 protrude in the axial direction at the circumference of the hub 231 and are inclined along the circumferential direction at spaced intervals, whereby the fan 230 intakes air in the axial direction and discharges air in a radial direction.

The rotation shaft 211 is disposed at the central portion of the hub 231. A first bearing assembly 260*a* and a second bearing assembly 260*b* are disposed around the rotation shaft 211 so as to rotatably support the rotation shaft 211. The stator 270 is disposed around both the first bearing 260*a* and the second bearing assembly 260*b*. A shaft base 215 is disposed at one end portion of the rotation shaft 211, so as to be integrally and rotatably coupled to the central portion of the hub 210 of the fan 230 via a high frequency bonding, although other suitable bonding techniques are contemplated by the present invention.

The stator 270 may include a stator core 271 layered (or insulated in any suitable manner) in the axial direction, a stator coil 273 wound onto the stator core 271, and an insulator 275 interposed between the stator core 271 and the stator coil 273 for the insulation therebetween.

The permanent magnet 221 is disposed at the outside of the stator 270 with a certain air gap therebetween so as to be integrally rotatable with the hub 231, thereby implementing an outer rotor type motor. Inside the hub 231 the permanent magnet supporting portion 237 is provided for supporting the permanent magnet 221. At one side end portion of the stator 270, i.e., at the bottom end portion of the stator 270 in the drawing, the PCB 281 and the molding portion 280 are provided. The molding portion 280 may be formed of any suitable material, such as a thermoplastic resin and in any suitable shape, such as a disc shape with a certain thickness such that the bottom end portion of the stator 270 can be integrally connected to the PCB 281.

The first blocking portion 290 is provided at an upper surface of the molding portion 280 outside the permanent magnet 221 and the permanent magnet supporting portion 237, so as to overlap the permanent magnet 221 and the permanent magnet supporting portion 237 by a certain length in the axial direction, thereby blocking the introduction of external foreign materials into the receiving space of the permanent magnet 221.

The second blocking portion 310 is provided inside the hub 231 to protrude along the axial direction of the rotation shaft 211, is spaced apart from the outer diameter surface of the molding portion 280 by a certain distance, and extends along the circumferential direction, thereby being implemented as a shape of a circular rib, although other suitable shapes are contemplated by the present invention. Accordingly, foreign materials outside the hub 231 can be blocked from being introduced inside thereof.

With such a configuration, upon applying power to the stator coil 273, the permanent magnet 221 and the fan 230 rotate around the central axis of the rotation shaft 211 by the interaction between the stator coil 273 and the permanent magnet 221. Here, the second blocking portion 310 blocks foreign materials outside the hub 231 from being introduced inside thereof. Also, the first blocking portion 290 can block foreign materials introduced through the second blocking portion 310 from being introduced into the receiving space of the permanent magnet 221.

A fan assembly in accordance with a third non-limiting embodiment of the present invention will now be described with reference to FIG. 9.

Figure 9:
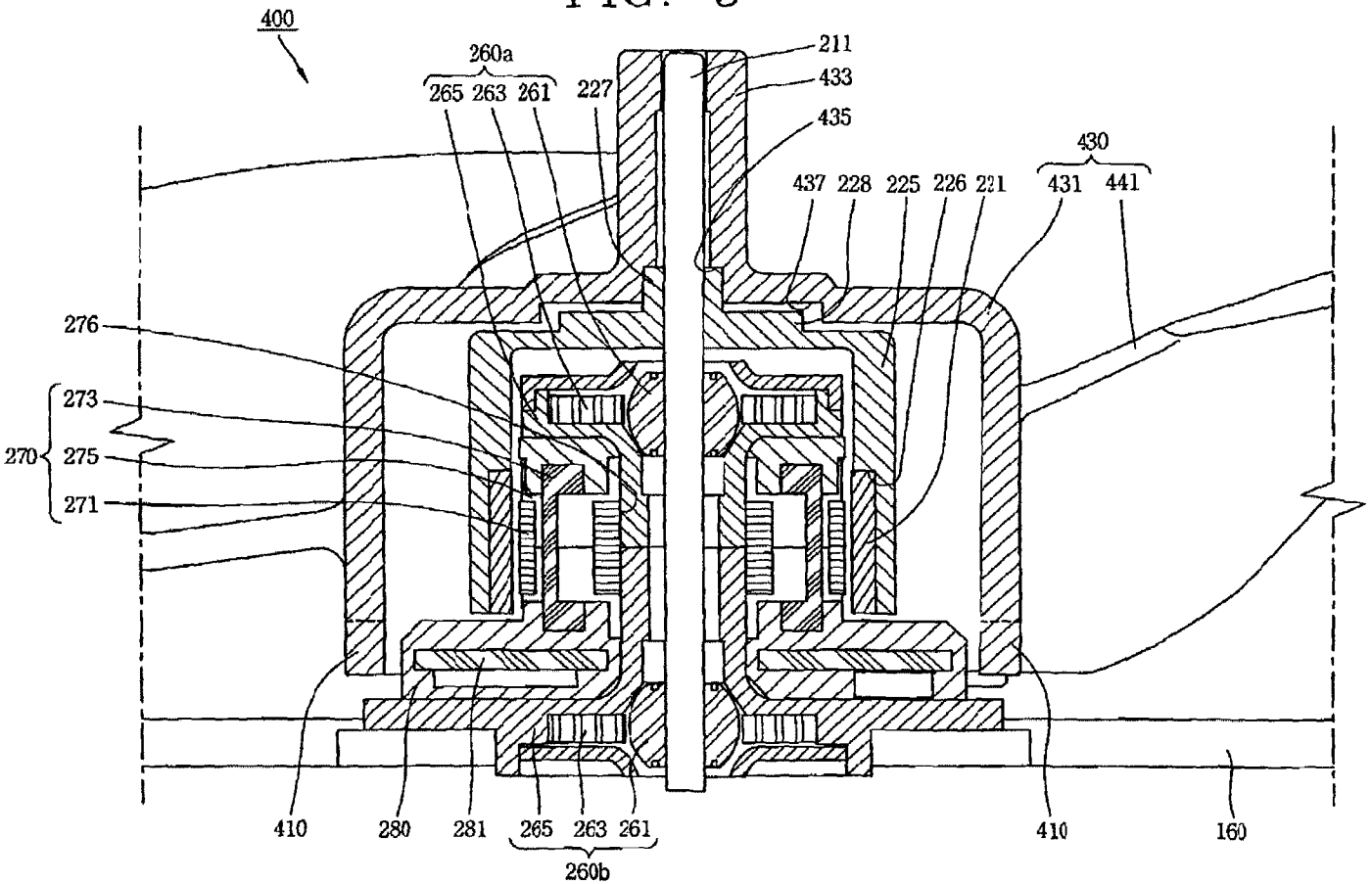
FIG. 9 shows a partially cutout cross-sectional view of a fan assembly in accordance with another non-limiting embodiment of the present invention.

As shown in FIG. 9, a fan assembly 400 may include a rotation shaft 211, a permanent magnet 221 having a receiving space therein and rotating around the central axis of the rotation shaft 211, a fan 430 rotating around the central axis of the rotation shaft 211, and including a hub 431 having a receiving space therein with one side open and disposed outside the permanent magnet 221, and a plurality of blades 441 disposed at a circumference of the hub 431, a stator 270 disposed inside the permanent magnet 221, a PCB 281 disposed at the open side of the hub 431, a molding portion 280 for allowing the PCB 281 to be integrally connected to one end portion of the stator 270, and a blocking portion 410 extending from the end of the hub 431 outside the molding portion 280 in the axial direction to overlap the molding portion 280.

The fan 430 may be implemented as a propeller type axial flow fan which blows air in an axial direction by including the hub 431 having one side open and may be cylindrically formed (although other suitable shapes are contemplated by the present invention) to have a receiving space therein, and a plurality of blades 441 extending from the circumference of the hub 431 in a radial direction and aligned to be spaced apart from one another in the circumferential direction. One side of the fan 430 is supported by a supporting member 160.

The rotation shaft 211 is disposed at the central portion of the hub 431. A first bearing assembly 260*a* and a second bearing assembly 260*b* each having a bearing 261, a felt 263 and a housing 265 all for rotatably supporting the rotation shaft 211 are provided at the circumference of the rotation shaft 211. The stator 270 is installed around the first and second bearing assemblies 260*a* and 260*b*.

The stator 270 may include a stator core 271 layered in the axial direction, a stator coil 273 wound onto the stator core 271, and an insulator 275 interposed between the stator core 271 and the stator coil 273 for the insulation therebetween. A coupling portion 276 for allowing the first bearing assembly 260*a* and the second bearing assembly 260*b* to be received for coupling is provided in the central area of the stator 270.

The permanent magnet 221 is disposed outside the stator 270 with a certain air gap therebetween, thereby configuring an outer rotor type motor. One side of the permanent magnet 221 is supported by a frame 225 having one side open in a cylindrical shape, although other suitable shapes are contemplated by the present invention.

A permanent magnet supporting portion 226 is configured as a recessed portion of an inner diameter surface of the frame 225. Thus, the frame 225 has an extended inner diameter in the radial direction. A stepped portion 228 outwardly protrudes from an end portion of the frame 225. A protrusion 227 is disposed at the central area of the stepped portion 228 and is configured to be inserted into the hub 431.

A shaft coupling portion 433 is provided such that the end portion of the rotation shaft 211 may be inserted therewithin to a certain depth through the central area of the hub 431. An insertion bore 435 in which the protrusion 227 is inserted is provided at one side of the shaft coupling portion 433. A recess portion 437 is configured to receive the stepped portion 228 therein, and is provided at the circumference of the insertion bore 435. In this regard, the insertion bore 435 may have a length shorter than the length of the protrusion 227, such that the frame 225 may be spaced apart from the inner surface of the hub 431.

The molding portion 280 having a disc shape (although other suitable shapes are contemplated by the present invention) is provided at one side end portion of the stator 270, i.e., a bottom end portion of the stator 270. The PCB 281 may be formed in any suitable shape, such as a disc shape and has a three-phase drive IC 283 and a capacitor 285 (see FIG. 4) aligned at one side of the stator 270. The molding portion 280 may be formed of any suitable material, such as a thermoplastic resin to have the disc shape with a certain thickness so as to allow the stator 270 to be integrally connected to the PCB 281.

The blocking portion 410 is provided at the end of the hub 431 outside the molding portion 280 along the radial direction to be spaced apart from the molding portion 280 by a certain distance, thereby overlapping the molding portion 280 by a certain length in the axial direction. Accordingly, foreign materials outside the hub 431 can be blocked from being introduced into the hub 431 to prevent deterioration of the fan assembly and restriction of the movement of rotatable components due to the presence of foreign materials. Here, the blocking portion 410 has the same thickness as that of the hub 431; however, it may be be thicker than the hub 431.

With such a configuration, upon applying power to the stator coil 273, the permanent magnet 221, the frame 225 and the fan 430 integrally rotate together with the rotation shaft 211. During operation, the blocking portion 410 can block external foreign materials from being introduced into the hub 431, thus preventing the restriction of the movement of the rotatable elements and the deterioration of the fan assembly 400 due to the presence of the foreign materials.

A fan assembly in accordance with a fourth non-limiting embodiment of the present invention will now be described with reference to FIGS. 10 and 11.

Figure 10:
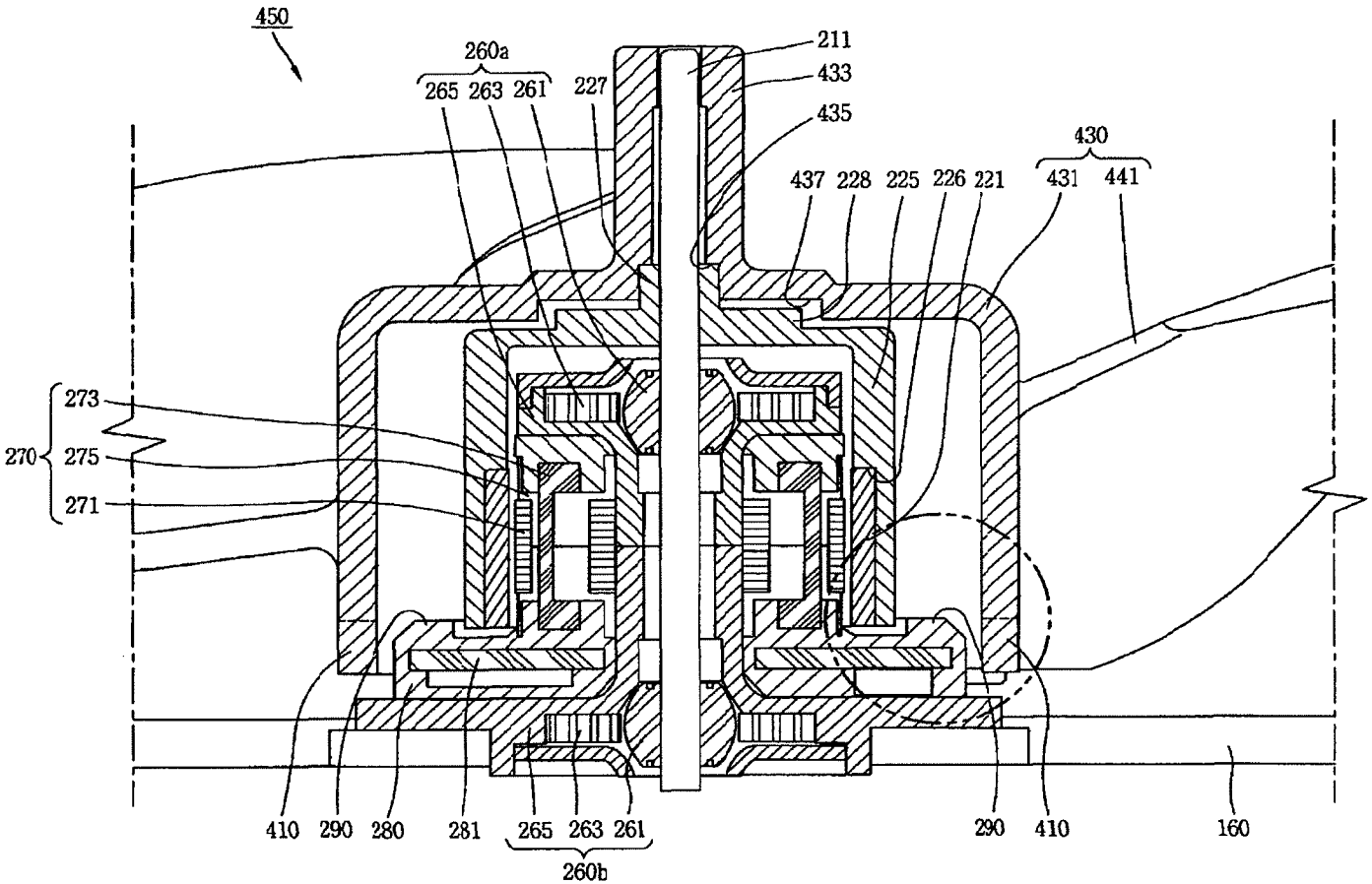
FIG. 10 shows a partially cutout cross-sectional view of a fan assembly in accordance with yet another non-limiting embodiment of the present invention.

As shown in FIG. 10, a fan assembly 450 may include a rotation shaft 211, a permanent magnet 221 having a receiving space therein and rotatable around the central axis of the rotation shaft 211, a fan 430 rotatable around the central axis of the rotation shaft 211, and including a hub 431 having a receiving space therein with one side open and disposed outside the permanent magnet 221, and a plurality of blades 441 disposed at a circumference of the hub 431, a stator 270 disposed inside the permanent magnet 221, a first blocking portion 290 disposed to overlap the end portion of the permanent magnet 221 by a certain distance in an axial direction, and a second blocking portion 410 disposed at the open area of the hub 431 to be spaced apart from the first blocking portion 290 in the radial direction.

The fan 430 may be implemented as a propeller type axial flow fan which blows air in the axial direction by including the hub 431, and a plurality of blades 441 protruding in the radial direction at the circumference of the hub 431 to be spaced apart from one another in the circumferential direction.

One end portion of the rotation shaft 211 is inserted into the central area of the hub 431. The first and second bearing assemblies 260*a* and 260*b* are disposed at the circumference of the rotation shaft 211 to rotatably support the rotation shaft 211. The stator 270 is coupled between the first and second bearing assemblies 260*a* and 260*b*. The permanent magnet 221 is rotatably coupled to the outside of the stator 270 with a certain air gap therebetween. One side of the permanent magnet 221 is supported by the frame 225 integrally coupled both to the rotation shaft 211 and to the hub 431. The molding portion 280 having a disc shape (although other suitable shapes are contemplated) is provided at one side of the stator 270 to allow the left end portion of the stator 270 to be integrally connected to the PCB 281.

The first blocking portion 290 protrudes from one side surface of the molding portion 280 along the radial direction of the permanent magnet 221 outside the permanent magnet supporting portion 226 so as to overlap the permanent magnet supporting portion 226 by a certain length in the axial direction. Accordingly, foreign materials outside the permanent magnet supporting portion 226 can be blocked from being introduced into the receiving space of the permanent magnet 221.

Figure 11:
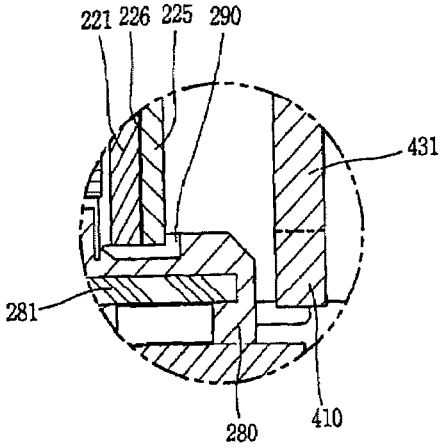
FIG. 11 shows an enlarged view of certain components of FIG. 10.

As shown in FIG. 11, the second blocking portion 410 extends from the end of the hub 431 in the axial direction outside the molding portion 280, so as to overlap the molding portion 280 by a certain length, whereby foreign materials outside the hub 431 can be blocked from being introduced into the hub 431. Here, the second blocking portion 410 has the same thickness as that of the hub 431; however, the second blocking portion 410 may be thicker than the hub 431.

With such a configuration, upon the rotation of the permanent magnet 221, the rotation shaft 211, and the fan 430, the second blocking portion 410 blocks foreign materials introduced into the hub 431 from the exterior, and the first blocking portion 290 blocks foreign materials introduced through the second blocking portion 410 from being introduced into the receiving space of the permanent magnet 221, thereby preventing the restriction and forced deterioration of the fan assembly due to the introduction of the foreign materials.

A fan assembly in accordance with a fifth non-limiting embodiment of the present invention will now be described with reference to FIG. 12.

Figure 12:
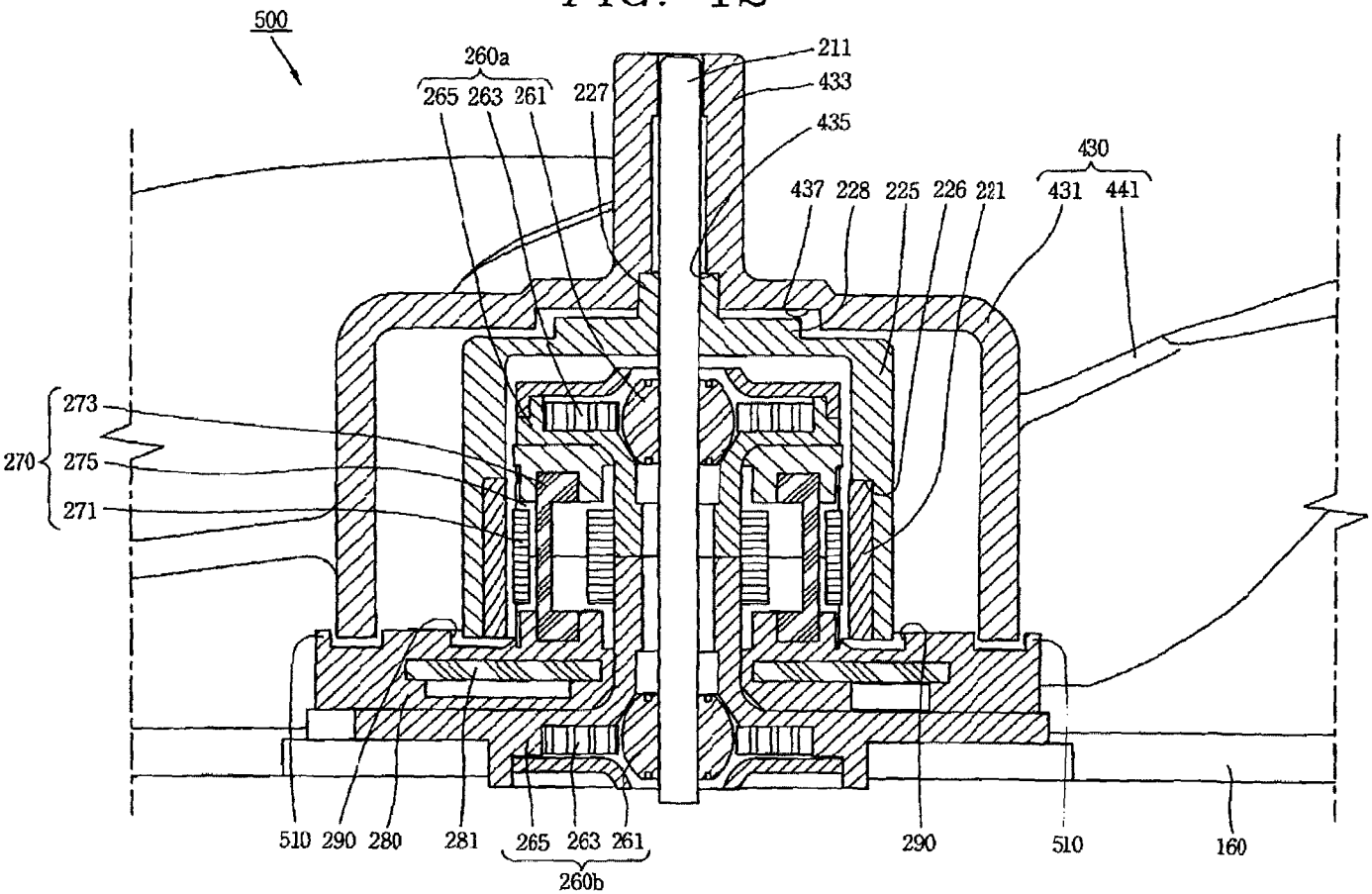
FIG. 12 shows a partially cutout cross-sectional view of a fan assembly in accordance with still another non-limiting embodiment of the present invention.

As shown in FIG. 12, a fan assembly 500 may include a rotation shaft 211, a permanent magnet 221 having a receiving space therein and rotatable around the central axis of the rotation shaft 211, a fan 430 being rotatable around the central axis of the rotation shaft 211 and including a hub 431 having a receiving space therein with one side open and disposed outside the permanent magnet 221, and a plurality of blades 441 disposed at a circumference of the hub 431, a stator 270 disposed inside the permanent magnet 221, a first blocking portion 290 disposed to overlap the end portion of the permanent magnet 221 by a certain distance in an axial direction, and a second blocking portion 510 disposed at the open area of the hub 431 to be spaced apart from the first blocking portion 290 in the radial direction thereof.

The fan 430 may be implemented as a propeller type axial flow fan with including the hub 431, and a plurality of blades 441 protruding in the radial direction at the circumference of the hub 431 to be spaced apart from one another in the circumferential direction.

The stator 270 is disposed inside the hub 431. The first bearing assembly 260*a* and the second bearing assembly 260*b* are coupled inside the stator 270 so as to support the rotation shaft 211. The permanent magnet 221 is disposed outside the stator 270 with a certain air gap therebetween to be rotatably supported by the frame 225. At one side of the stator 270 a molding portion 280 may be formed of any suitable material, such as a thermoplastic resin in any suitable shape, such as a disc shape, so as to allow the stator 270 to be integrally connected to the PCB 281.

The first blocking portion 290 protrudes from the upper surface of the molding portion 280 along the radial direction of the permanent magnet 221 outside the permanent magnet supporting portion 226 so as to overlap the permanent magnet supporting portion 226 by a certain length in the axial direction. Accordingly, foreign materials outside the permanent magnet supporting portion 226 can be blocked from being introduced into the receiving space of the permanent magnet 221.

The second blocking portion 510 protrudes from the molding portion 280 in the radial direction of the molding portion 280 outside the first blocking portion 290 so as to overlap the end portion of the hub 431 by a certain length in the axial direction. Thus, external foreign materials can be blocked from being introduced into the hub 431.

With such a configuration, when the permanent magnet 221 and the fan 430 rotate around the central axis of the rotation shaft 211, the second blocking portion 510 blocks external foreign materials from being introduced into the hub 431. The first blocking portion 290 blocks foreign materials introduced through the second blocking portion 510 from being introduced into the permanent magnet supporting portion 226, thereby preventing the restriction and forced deterioration of the fan assembly due to the introduction of foreign materials.

A fan assembly in accordance with a sixth non-limiting embodiment of the present invention will now be described with reference to FIG. 13.

Figure 13:
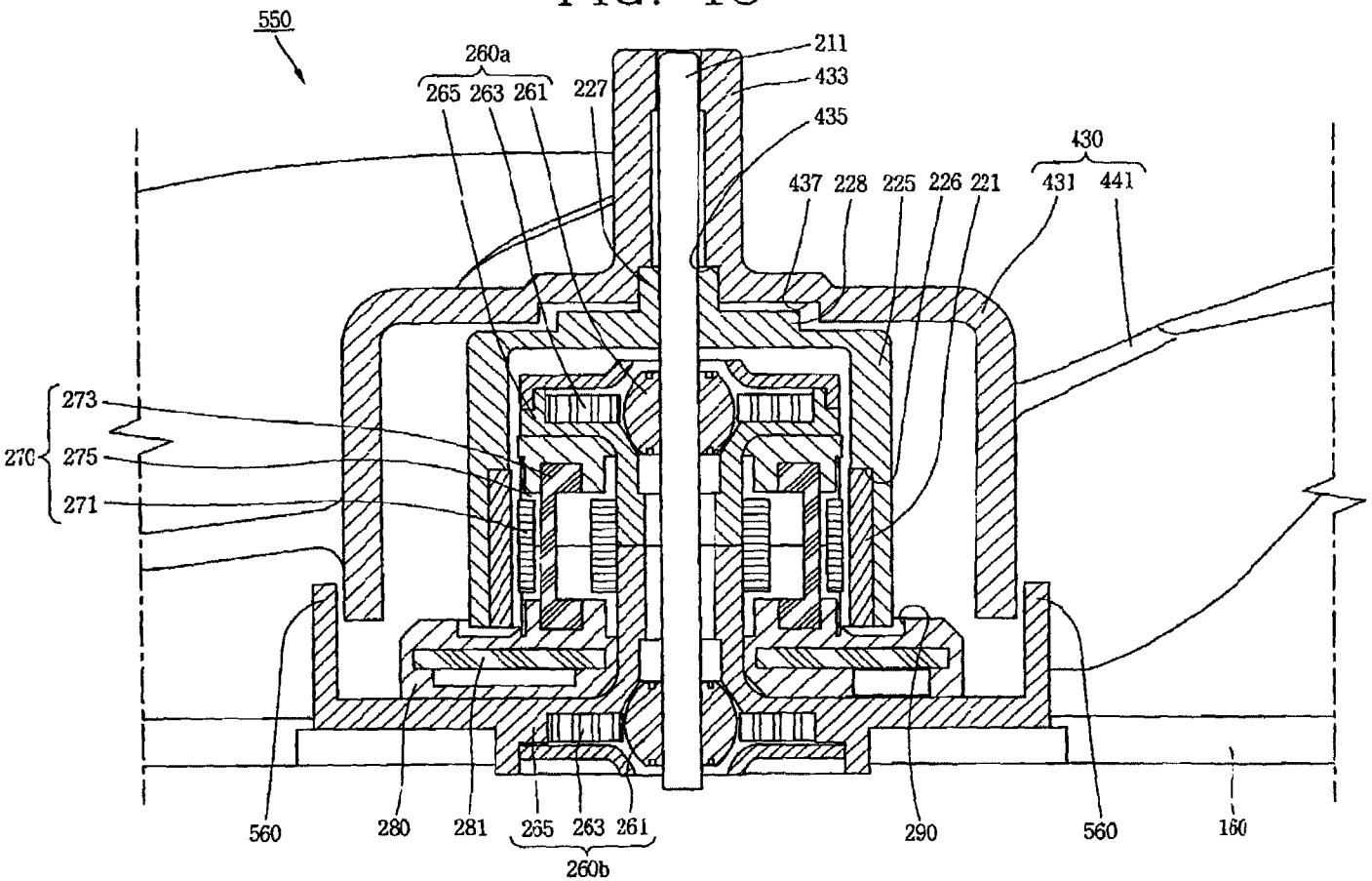
FIG. 13 shows a partially cutout cross-sectional view of a fan assembly in accordance with a further non-limiting embodiment of the present invention.

As shown in FIG. 13, a fan assembly 550 may include a rotation shaft 211, a permanent magnet 221 having a receiving space therein and rotatable around the central axis of the rotation shaft 211, a fan 430 being rotatable around the central axis of the rotation shaft 211 and including a hub 431 having a receiving space therein with one side open and disposed outside the permanent magnet 221, and a plurality of blades 441 disposed at a circumference of the hub 431, a stator 270 disposed inside the permanent magnet 221, a first blocking portion 290 disposed to overlap the end portion of the permanent magnet 221 in a non-contacted state with each other by a certain distance in an axial direction, and a second blocking portion 560 disposed at the open side of the hub 431 to be spaced apart from the first blocking portion 290 in the radial direction thereof. That is, the second blocking portion 560 is provided at an outer circumferential surface of the hub 431, extends along the outer circumferential surface in a radial direction, and overlaps a portion of the hub 431 adjacent the open side of the hub 431.

The fan 430 may be implemented as a propeller type axial flow fan including the hub 431, and a plurality of blades 441 protruding from the circumference of the hub 431 in the radial direction to be spaced apart from one another in the circumferential direction.

The stator 270 is disposed inside the hub 431. The first bearing assembly 260*a* and the second bearing assembly 260*b* are coupled inside the stator 270 so as to support the rotation shaft 211. The permanent magnet 221 is disposed outside the stator 270 with a certain air gap therebetween to be rotatably supported by the frame 225. At one side of the stator 270 the molding portion 280 may be formed of any suitable material, such as a thermoplastic resin in any suitable shape, such as a disc shape, so as to allow the stator 270 to be integrally connected to the PCB 281.

The first blocking portion 290 protrudes from one side surface of the molding portion 280 along the radial direction of the permanent magnet 221 outside the permanent magnet supporting portion 226 so as to overlap the permanent magnet supporting portion 226 by a certain length in the axial direction. Accordingly, foreign materials outside the permanent magnet supporting portion 226 can be blocked from being introduced into the receiving space of the permanent magnet 221.

The second bearing assembly 260*b* is provided at a central portion of an interior space of the second blocking portion 560. The second blocking portion 560 may be formed in any suitable shape, such as a cylindrical rib that protrudes from housing 265 outside the hub 431 in the radial direction thereof and spaced apart from the hub 431 by a certain distance, to overlap the hub 431 by a certain length in the axial direction. Accordingly, external foreign materials can be blocked from being introduced into the hub 431.

With such a configuration, when the permanent magnet 221 and the fan 430 rotate around the central axis of the rotation shaft 211, the second blocking portion 560 blocks external foreign materials from being introduced into the hub 431. The first blocking portion 290 blocks foreign materials introduced through the second blocking portion 560 from being introduced into the permanent magnet supporting portion 226, thereby providing an additional barrier to prevent foreign materials from restricting the movement of rotatable components and the deterioration of the fan assembly.

A fan assembly in accordance with a seventh non-limiting embodiment of the present invention will now be described with reference to FIG. 14.

Figure 14:
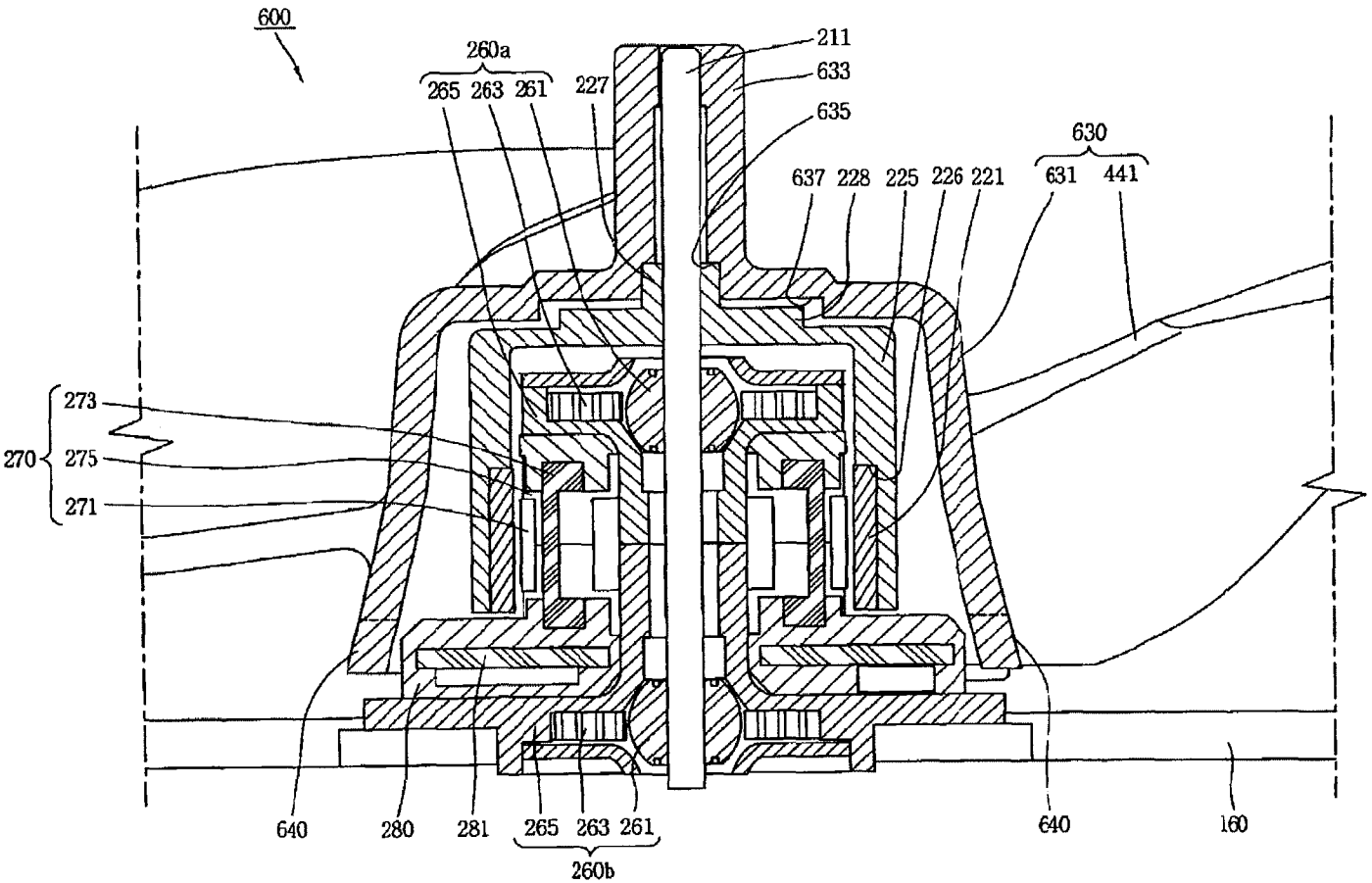
FIG. 14 shows a partially cutout cross-sectional view of a fan assembly in accordance with a still further non-limiting embodiment of the present invention.

As shown in FIG. 14, a fan assembly 600 may include a rotation shaft 211, a permanent magnet 221 having a receiving space therein and rotatable around the central axis of the rotation shaft 211, a fan 630 being rotatable around the central axis of the rotation shaft 211 and including a hub 631 having a receiving space therein with one side open and disposed outside the permanent magnet 221, and a plurality of blades 441 disposed at a circumference of the hub 631, a stator 270 disposed inside the permanent magnet 221, and a blocking portion 640 disposed at the open area of the hub 631 in an axial direction to block introduction of foreign materials into the receiving space of the permanent magnet 221.

The fan 630 may be implemented as a propeller type axial flow fan which blows air in the axial direction by including the hub 631, and the plurality of blades 441 protruding in the radial direction at the circumference of the hub 631 to be spaced apart from one another in the circumferential direction.

One end portion of the rotation shaft 211 is inserted into the central area of the hub 631 by a certain depth. The first bearing assembly 260*a* and the second bearing assembly 260*b* are disposed around the rotation shaft 211. The stator 270 is coupled between the first bearing assembly 260*a* and the second bearing assembly 260*b*. The permanent magnet 221 supported by the frame 225 is disposed outside the stator 270 with a certain air gap therebetween.

A molding portion 280 may be formed of any suitable material, such as a thermoplastic resin in any suitable shape, such as a disc shape with a certain thickness, is provided at one side of the stator 270, i.e., at a bottom end portion of the stator 270, so as to cover both the bottom end portion of the stator 270 and the PCB 281.

The hub 631 is configured such that its diameter gradually increases toward its open side, i.e., toward the molding portion 280. A shaft coupling portion 633, in which one end portion of the rotation shaft 211 is inserted, outwardly protrudes from an outer surface of the hub 631. Also, an insertion bore 635 in which the protrusion 227 of the frame 225 is inserted and a recess portion 637 in which a stepped portion 228 of the frame 225 is received are provided at the hub 631, respectively.

The blocking portion 640 is configured such that the bottom end portion of the hub 631 is spaced apart from the outer surface portion of the molding portion 280 by a certain distance to overlap each other by a certain length in the axial direction. Accordingly, foreign materials outside the hub 631 can be blocked from being introduced inside through a narrow gap of the overlapped portion of the hub 631. Here, the blocking portion 640 has the same thickness as that of the hub 631; however, the blocking portion 640 may be thicker or thinner than the hub 631.

With such a configuration, upon applying power to the stator 270, the permanent magnet 221 and the fan 630 rotate around the central axis of the rotation shaft 211. Here, the blocking portion 640 blocks external foreign materials from being introduced into the hub 631. Accordingly, the restriction and the deterioration of rotatable elements, such as the frame 225, the permanent magnet 221, the rotation shaft 211 and the like, can be prevented.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

As described above, according to the present invention, foreign materials which may be introduced into a fan through an open side of the fan can be blocked, so as to prevent restriction of the movement of rotatable components, the deterioration of the fan assembly, and a decrease in the operational lifespan of the fan assembly due to the presence of foreign materials.

In the present invention, a permanent magnet and a stator are disposed inside a hub of the fan and a molding portion and a blocking portion(s) are disposed at an open side of the hub. Accordingly, the length of the fan in an axial direction can be shortened and also the introduction of foreign materials through the open side of the fan can be prevented.

In addition, the molding portion is formed to cover a PCB to protect the PCB from moisture or water. The molding portion also allows the integral connection between the stator and the PCB, thus simplifying a fabricating process and reducing a fabricating cost.

Also, in the present invention, a first blocking portion and a second blocking portion are disposed at the open side of the hub of the fan. Accordingly, foreign materials, e.g., moisture, ice, dust or the like, can more effectively be blocked from being introduced into the fan.

Furthermore, in the present invention, a permanent magnet rotating outside the stator is disposed inside a centrifugal fan, which allows the fan to decrease in size, both in a radial direction and in an axial direction, resulting in the advantage of minimizing the fan, such that a fan assembly is configured to increase the capacity inside the refrigerator.

Also, in the present invention, a nipple protruding from the central area of the hub in the axial direction is provided, and a shaft receiving portion in which an end portion of the rotation shaft is inserted is provided in the nipple, so as to facilitate the coupling between the rotation shaft and the hub. Moreover, the nipple is received in the shaft receiving portion, which can facilitate the rotation shaft to match with the central area of the hub and also prevent a relative movement of the rotation shaft and the hub in a vertical direction.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A fan assembly comprising:

a shaft;

a fan having a hub to rotate around the shaft;

a permanent magnet to rotate with the fan around the shaft;

a stator disposed in opposing relation to the permanent magnet; and a blocker having a recess opposing the permanent magnet, wherein:

the permanent magnet rotates around the shaft in a clearance formed by the recess in the blocker, the hub includes a first surface and a second surface, the first surface of the hub is coupled to the second surface and is located between the second surface and the shaft, the second surface of the hub is coupled to a blade of the fan, and wherein the fan assembly further comprises:

a printed circuit board to control operation of the fan and being disposed at an open side of the hub; and a molding section to allow the printed circuit board to be integrally coupled to an end portion of the stator, the molding section substantially covering the printed circuit board and the end portion of the stator such that the printed circuit board can be waterproof, wherein the first surface of the hub is formed to be cylindrical by protruding parallel with the shaft to extend in a circumferential direction of the hub, wherein the permanent magnet is attached onto a radially inner side of the first surface of the hub, and wherein the second surface of the hub slants in a direction away from the shaft, and wherein the blocker and the first surface of the hub are separated by a first distance, and the blocker and the slanted second surface of the hub coupled to the fan blade are separated by a second distance greater than the first distance.

2. The fan assembly of claim 1, wherein the recess of the blocker is located along an axis that passes through the first surface of the hub.

3. The fan assembly of claim 1, wherein the blocker overlaps the printed circuit board.

4. The fan assembly of claim 3, wherein the blocker is between the printed circuit board and the permanent magnet.

5. The fan assembly of claim 3, wherein the blocker is coupled to the printed circuit board.

6. The fan assembly of claim 1, wherein a surface of the blocker is a first distance from a bottom surface of the recess and is a second distance from a bottom surface of the permanent magnet, and wherein the second distance is equal to or greater than the first distance.

7. The fan assembly of claim 1, wherein the hub further includes:

a nipple protruding from a central area of the hub in an axial direction, and a shaft receiving portion in which an end portion of the shaft is inserted.

8. A fan assembly comprising:

a shaft;

a fan having a blade and a hub to rotate around the shaft, the hub including a first surface and a second surface, the first surface of the hub being coupled to the second surface of the hub and is located between the second surface and the shaft, the blade of the fan being coupled to the second surface of the hub, wherein the first surface of the hub having a cylindrical shape by protruding parallel with the shaft to extend in a circumferential direction of the hub, wherein the second surface of the hub slants in a direction away from the shaft, a permanent magnet to rotate with the fan, wherein the permanent magnet is coupled to a radially inner side of the first surface of the hub;

a stator disposed in an opposing relation to the permanent magnet;

a blocker having a recess that faces the permanent magnet, wherein the permanent magnet rotates around the shaft in a clearance formed by the recess of the blocker;

a circuit board at one side of the hub to control operation of the fan; and a molding section to substantially cover the circuit board and an end portion of the stator such that the circuit board is waterproof, wherein the blocker and the first surface of the hub are separated by a first distance, and the blocker and the slanted second surface of the hub coupled to the fan blade are separated by a second distance that is greater than the first distance.

9. The fan assembly of claim 8, wherein the recess of the blocker is along an axis that passes through the first surface of the hub.

10. The fan assembly of claim 8, wherein the blocker overlaps the circuit board.

11. The fan assembly of claim 10, wherein the blocker is between the circuit board and the permanent magnet.

12. The fan assembly of claim 10, wherein the blocker is coupled to the printed circuit board.

13. The fan assembly of claim 8, wherein a surface of the blocker is a first distance from a bottom surface of the recess, and is a second distance from a bottom surface of the permanent magnet, and wherein the second distance is equal to or greater than the first distance.

14. The fan assembly of claim 8, wherein the hub further includes:

a nipple protruding from a central area of the hub in an axial direction, and a shaft receiving portion to receive an end portion of the shaft.

* * * * *